US005099926A

United States Patent [19]

Fushiya et al.

[11] Patent Number: 5,099,926

[45] Date of Patent: Mar. 31, 1992

[54] IMPACT TOOL

[75] Inventors: Fusao Fushiya; Takashi Yamazaki; Yoshio Sugiyama, all of Anjo, Japan

[73] Assignee: Makita Corporation, Anjo, Japan

[21] Appl. No.: 679,246

[22] Filed: Apr. 2, 1991

[30] Foreign Application Priority Data

Apr. 5, 1990 [JP] Japan ..... 2-90983

[51] Int. Cl.[5] ..... B25D 11/12

[52] U.S. Cl. ..... 173/17; 173/200

[58] Field of Search ..... 173/17, 116, 128, 133

[56] References Cited

U.S. PATENT DOCUMENTS

| | | | |
|---|---|---|---|
| 464,820 | 12/1891 | Drawbaugh | 173/17 |
| 3,688,848 | 9/1972 | Vick et al. | 173/116 |
| 4,290,492 | 9/1981 | Sides et al. | 173/118 |
| 4,582,144 | 4/1986 | Mizutani | 173/14 |

*Primary Examiner*—Douglas D. Watts
*Assistant Examiner*—John M. Husar
*Attorney, Agent, or Firm*—Dennison, Meserole, Pollack & Scheiner

[57] ABSTRACT

An impact tool includes a body, a barrel mounted on the body and a cylinder disposed within the barrel and reciprocally moved by a drive mechanism. A communication groove is formed between the cylinder and the barrel and communicates with the outside. The cylinder includes a plurality of communication holes formed in a radial direction and spaced from each other in a longitudinal direction. A striker is reciprocally movable within the cylinder, and an air chamber is formed between the striker and the cylinder. The striker is positioned at a first position when the tool bit is not pressed on a work. The striker at the first position permits communication between the air chamber and the communication groove through any one of the communication holes so as to be prevented from idle impact. Further, the striker is movable to a second position rearward of the first position through the pressing operation of the tool bit on the work. The striker at a position rearwardly of the second position prevents communication between the air chamber and the communication groove so as to permit normal impact operation by the tool bit.

8 Claims, 10 Drawing Sheets

IMPACT TOOL

BACKGROUND OF THE INVENTION

1. Field of the Invention

The present invention relates to an impact tool such as an electric hammer which is provided with a striker operable to deliver impact to a tool bit through pneumatic spring action.

2. Description of the Prior Art

A conventional impact tool such as an electric hammer includes a body having a barrel for receiving a movable cylinder which is reciprocally movable in the barrel. The cylinder in turn receives a striker which is reciprocally movable therewithin. An air chamber is formed within the cylinder defined by the striker. The air within the air chamber is compressed by the reciprocal movement of the cylinder and the striker is moved toward the tool bit to deliver impact thereto by the compressed air force or pneumatic spring action.

To prevent idling or idle percussive action of the striker, the cylinder includes an air replenishing port and an air escape port at predetermined positions. The air chamber communicates with the outside through the air escape port when the striker is positioned at a position in the vicinity of its forward stroke end in the case that the tool bit is not mounted on the barrel or the tool bit is not pressed on a work. The air within the air chamber is, therefore, not compressed by the reciprocal movement of the cylinder, so that the idle percussive action of the striker is prevented. The impact operation can be made by the reciprocal movement of the cylinder when the tool bit is mounted on the barrel and is pressed on the work so as to move the striker therefore together to a position where the air escape port is closed by the striker.

U.S. Pat. Nos. 3,688,846 and 4,290,492 disclose such conventional impact tools.

In such prior art impact tools, only one air escape port is provided for communication between the air chamber and the outside so as to prevent idling of the striker throughout the reciprocal movement of the cylinder and to permit normal impact operation when it is closed by the striker as stated above. The position of the air escape port in the cylinder is therefore determined in accordance with the stroke of the striker. Thus, when it is desired to construct the cylinder to have a long stroke, the stroke of the tool bit for closing the air escape port as well as that of the striker becomes also longer. Consequently, the length of the whole impact tool becomes longer, so that the weight of the impact tool increases to cause difficulty in handling of the tool.

Further, in the prior art impact tools, the tool bit is pressed on the work so as to move the striker therefore together to a position to close the air escape port so as to obtain air tight of the air chamber. The tool bit is pressed on the work with the whole tool held by the operator, and therefore, the positive pressure by the compressed air in the air chamber creates reaction force against the tool bit, so that the whole tool is lifted. This may prevent reliable operation of the tool including the operation for pressing the tool bit on the work.

SUMMARY OF THE INVENTION

It is, accordingly, an object of the present invention to provide an impact tool in which a movable cylinder can be constructed to have a long stroke for increasing an impact force while the impact tool has relatively small size and relatively light weight, so that the tool can be easily handled and reliably operated.

According to the present invention, there is provided an impact tool comprising:

a body;

a barrel mounted on the body;

a mounting portion of a tool bit disposed at a forward end of the barrel.

a cylinder disposed within the barrel and having a closed rear end and an open forward end, the cylinder forming between the inner wall of the barrel a communication groove which communicates with the outside, and having a plurality of communication holes formed in a radial direction and spaced from each other at a predetermined distance in a longitudinal direction of the cylinder;

a drive mechanism mounted on the body and connected with the cylinder so as to reciprocally move the cylinder within the barrel; and a striker reciprocally movable within the cylinder so as to form an air chamber between the inner wall of the cylinder, the striker being positioned at a first position when the tool bit mounted on the mounting portion is not pressed on a work, and being movable to a second position rearward of the first position through the pressing operation of the tool bit on the work.

The striker at the first position permits communication between the air chamber and the communication groove through any one of the communication holes during the reciprocal movement of the cylinder within the barrel, so that the striker may be prevented from idle impact. Further, the striker at a position rearwardly of the second position prevents communication between the air chamber and the communication groove, so that the striker may be reciprocally moved as the movement of the cylinder so as to permit normal impact operation by the tool bit. The communication holes may include at least one first communication hole and at least one second communication hole.

Preferably, the communication holes further include at least one intermediate communication hole disposed between the first communication hole and the second communication hole.

The first communication hole communicates with the communication groove when the cylinder reaches a position in the vicinity of its forward stroke end. The second communication hole communicates with the communication groove throughout the movement of the cylinder and is closed by the striker when the striker is positioned at the second position or rearwardly of the second position.

The first communication hole and the second communication hole are displaced from each other in a circumferential direction of the cylinder. The communication groove includes a first groove and at least one second groove formed on the inner wall of the barrel. The first groove is positioned to circumferentially coincide with the first communication hole and has a predetermined width in a longitudinal direction of the barrel. The second groove is positioned to circumferentially coincide with the second communication hole and extending in the longitudinal direction of the barrel.

A plurality of the first communication holes and a plurality of the second communication holes may be disposed at a predetermined distance in a circumferential direction to each other, respectively. The first groove may have an annular profile and a plurality of second grooves are provided in correspondence to the second communication holes.

The first groove and the second grooves communicate with each each other, and the first groove communicate with the outside through the second grooves.

The invention will become more fully apparent from the claims and the description as it proceeds in connection with the drawings.

DETAILED DESCRIPTION OF THE PREFERRED EMBODIMENT

Figure 1:
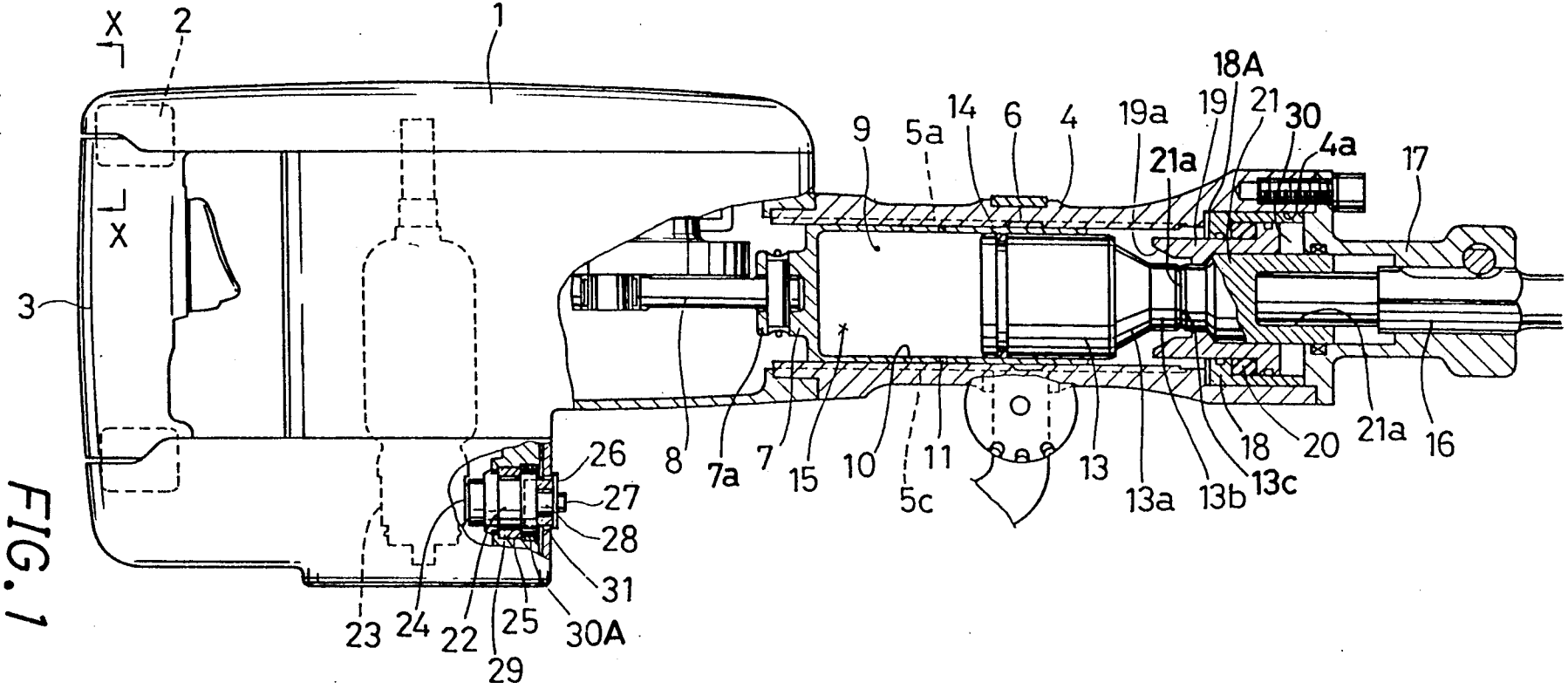
FIG. 1 is a front view, with a portion broken away for clarity, of a body of an electric hammer according to the present invention.

Referring to FIG. 1, there is shown a body 1 of an electric hammer according to the present invention. A handle 3 is mounted on one end of the body 1. A bumper member 2 such as a rubber material is interposed between the body 1 and the handle 3. A barrel 4 is fixedly mounted on the other end of the body 1 and accommodates a movable cylinder 7 as will be hereinafter explained. The body 1 accommodates a motor (a rotor 23 of the motor is shown by a dotted line) and a crank mechanism (not shown) which is driven by the motor.

Four straight ventilation grooves 5*a* to 5*d* are formed on the inner wall of the barrel 4 in a longitudinal direction thereof. The ventilation grooves 5*a* to 5*d* extend in parallel with each other and are spaced from each other at an angle of 90° (see FIG. 3). (For convenience sake, in FIGS. 1, 2, 8A to 8D and 9A to 9D, the ventilation grooves 5*a* and 5*c* are shown by dotted lines at the top and the bottom of the inner wall of the barrel 4 and are displaced at an angle of 45° from their proper positions, respectively.) The ventilation grooves 5*a* to 5*d* communicate with the outside through the interior of the body 1. An annular groove 6 is formed on the inner surface of the barrel 4 at the middle portion in a longitudinal direction. The width of the annular groove 6 is about ⅓ of the length of a striker 13 as will be hereinafter explained. The annular groove 6 communicates with the ventilation grooves 5*a* to 5*d* and further with the outside.

The movable cylinder 7 is disposed within the barrel 4 and is slidably movable therewithin. The cylinder 7 is closed at the rear end and is opened at the forward end. The closed end of the cylinder 7 is formed with a bracket 7*a* which is pivotally connected with a rod 8 of the crank mechanism.

Figure 2:
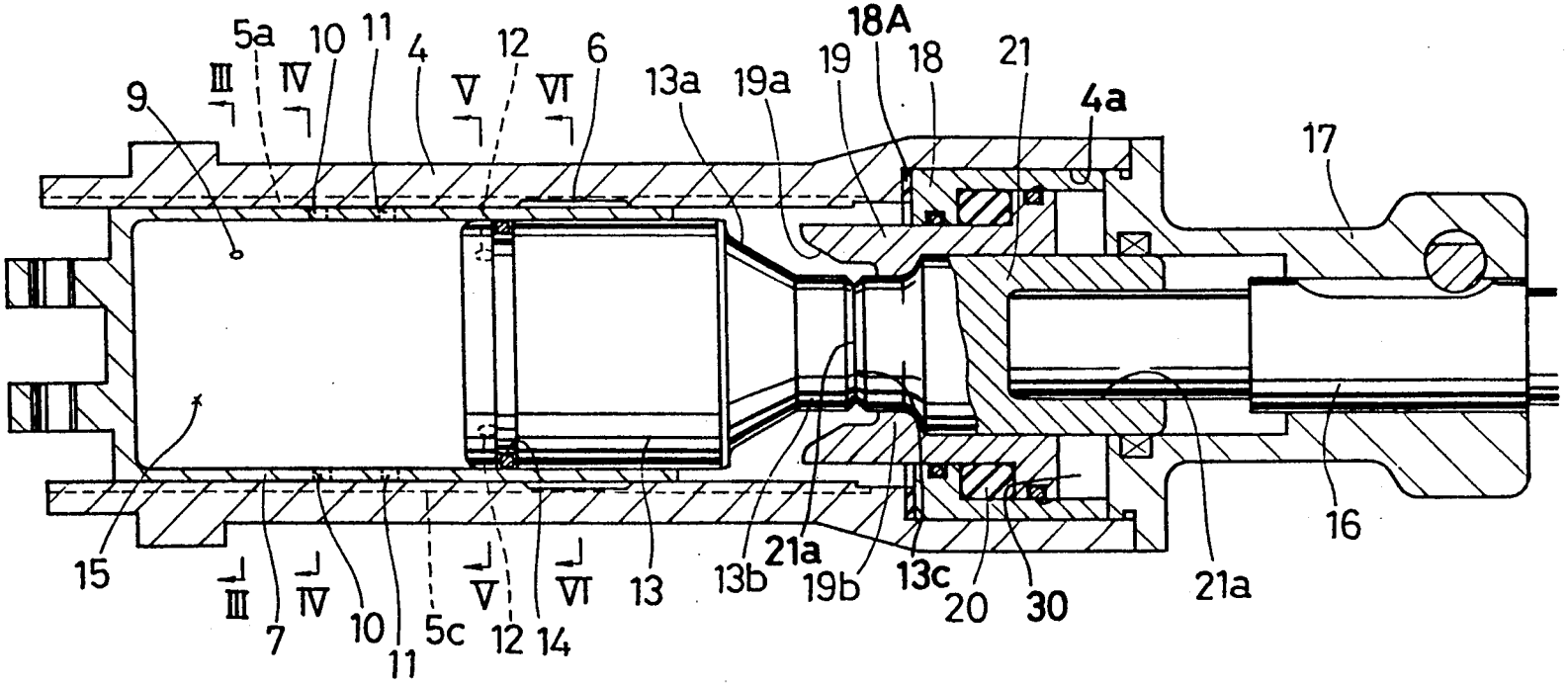
FIG. 2 is an enlarged view of a barrel of the body of the electric hammer shown in FIG. 1.

As shown in FIG. 2, the cylinder 7 includes on a cylindrical wall thereof an air replenishing hole 9, a plurality of first ventilation holes 10, a plurality of intermediate ventilation holes 11 and a plurality of second ventilation holes 12 which are radially extending through the cylindrical wall and are successively positioned within a range between the closed end of the cylinder 7 and substantially the middle portion thereof in such a manner that they are spaced from each other at a predetermined distance in a longitudinal direction of the cylinder 7.

Figure 3:
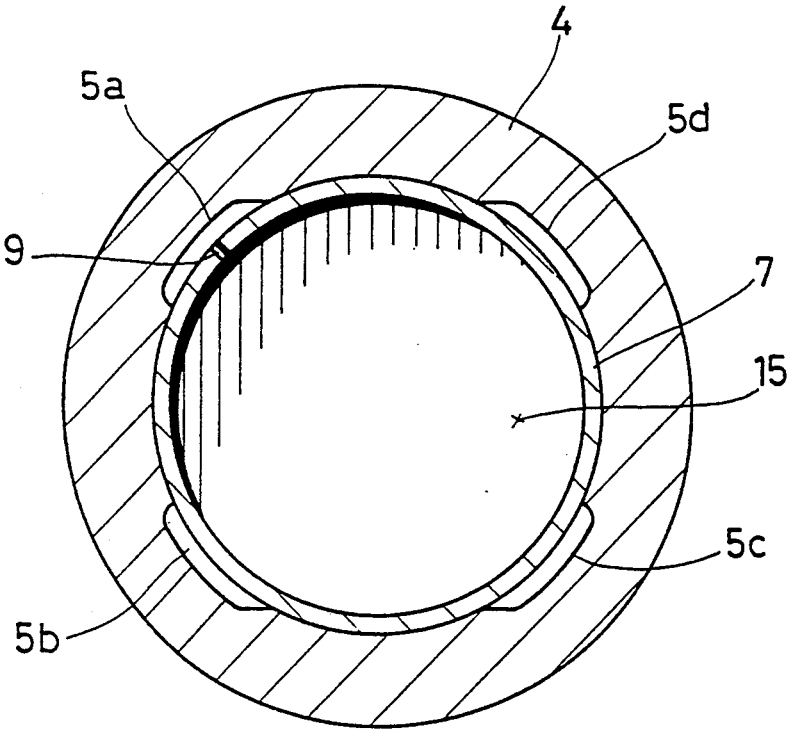
FIG. 3 is an enlarged sectional view taken along the line III—III in FIG. 2.
Figure 4:
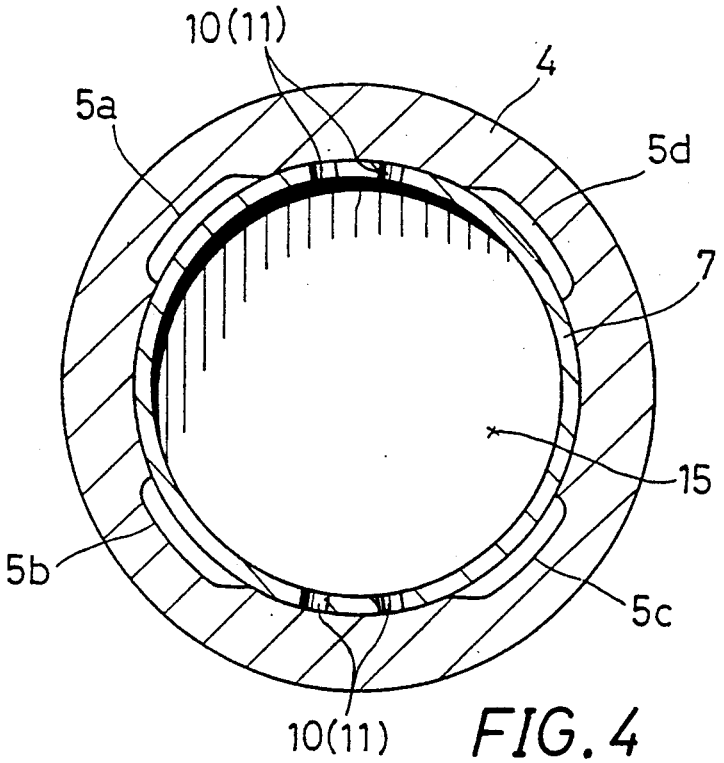
FIG. 4 is an enlarged sectional view taken along the line IV—IV in FIG. 2.

The air replenishing hole 9 has relatively small diameter and is communicated with the ventilation groove 5*a* as shown in FIG. 3. The first ventilation holes 10 and the intermediate ventilation holes 11 are four in number and are displaced from the ventilation grooves 5*a* to 5*d* in a circumferential direction, respectively, as shown in FIG. 4. The ventilation grooves 12 are also four in number and are equally separated from each other in a circumferential direction. The ventilation grooves 12 are angularly displaced from the first ventilation holes 10 in such a manner that the communicate with the ventilation grooves 5*a* to 5*d*, respectively.

A striker 13 is slidably inserted within the cylinder 7 and is reciprocally movable therewithin. A seal ring 14 is mounted on the rear end (left side in FIG. 1) of the striker 13. The striker 13 includes at the forward end (right side in FIG. 1) thereof a tapered shaft portion 13*a* and an impact shaft portion 13*b* of relatively small diameter. An air chamber 15 is defined by the inner wall of the cylinder 7 and the rear end of the striker 13.

The barrel 4 is formed with a recess 4*a* at the forward portion for receiving a cylinder 18 which abut on the rear surface of the recess 4*a* via a cushion member 18A such as rubber. A cylindrical tool holder 17 for insertion of a tool bit 16 is mounted on the forward end of the barrel 4, so that the cylinder 18 is held in position. A cylindrical impact bolt holder 19 is slidably received within the cylinder 18. The cylinder 18 provides an air cushion for the impact bolt holder 19 based on the correlation between positive pressure and negative pressure when the impact bolt holder 19 is moved as will be hereinafter explained. The cylinder 18 and the impact bolt holder 19 include an inwardly extending flanged portion and an outwardly extending flanged portion which abut on the outer surface of the impact bolt holder 19 and the inner surface of the cylinder 18, respectively, and form therebetween a chamber 30 (see FIG. 8A) in which a cushion material 20 such as rubber is disposed at the rear end of the chamber 30. The range of movement of the impact bolt holder 19 is defined between the cushion material 20 and the rear end of the tool holder 17 and is determined such that this range is smaller than that of the reciprocal movement of the striker 13.

The inner surface of the rear end of the impact bolt holder 19 includes a tapered portion 19*a* corresponding to the tapered shaft portion 13*a* of the striker 13 and also includes an annular protrusion 19*b* forwardly adjacent the tapered portion 19*a*. An impact bolt 21 is slidably inserted within the impact bolt holder 19. The forward portion of the impact bolt 21 includes a hole 21*a* for receiving a shank of the tool bit 16 and is partly slidably inserted into the tool holder 17. The rearward portion of the impact bolt 21 has relatively small diameter so as to abut on the annular protrusion 19*b* of the impact bolt holder 19 and has an end surface 21*a* opposed to the end surface 13*c* of the impact shaft portion 13*b* of the striker 13 for receiving impact therefrom.

As shown in FIG. 1, a brush holder 22 is mounted on a body 1 for holding a brush 24 in a position opposed to the rotor 23 of the motor. A stepped mounting hole 25 is formed on the body 1 for fitting the brush holder 22. One end of the brush holder 22 is supported by a cap 28 which is kept in position against the body 1 through a cover 26 and a screw 27. Portions of small diameter and large diameter of the brush holder 22 is held within the mounting hole 25 by a rubber vibration isolator 29 and a plastic material 30A which is pressed into the mounting hole 25, respectively, and therefore, the brush holder 22 is not directly secured to the body 1. Additionally, the cap 28 is fitted into the body 1 through a bush 31 made of rubber, etc.

The operation of the impact tool of the above embodiment will be hereinafter explained.

Figure 5:
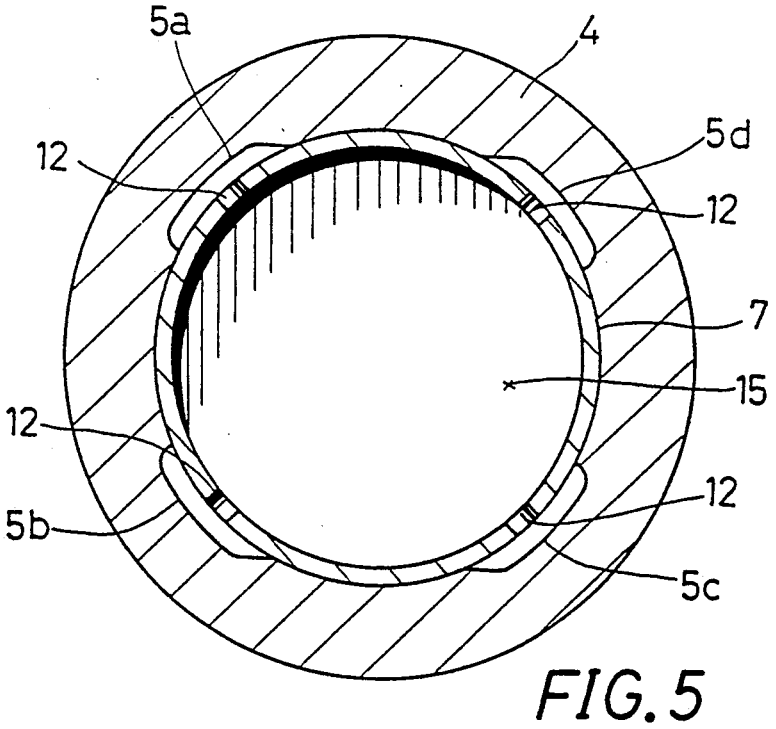
FIG. 5 is an enlarged sectional view taken along the line V—V in FIG. 2.
Figure 6:
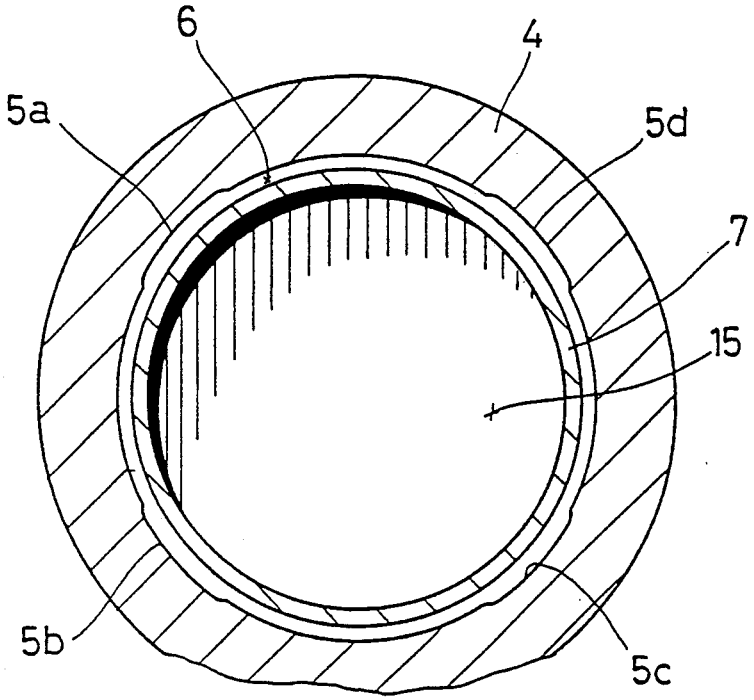
FIG. 6 is an enlarged sectional view taken along the line VI—VI in FIG. 2.
Figure 8A:
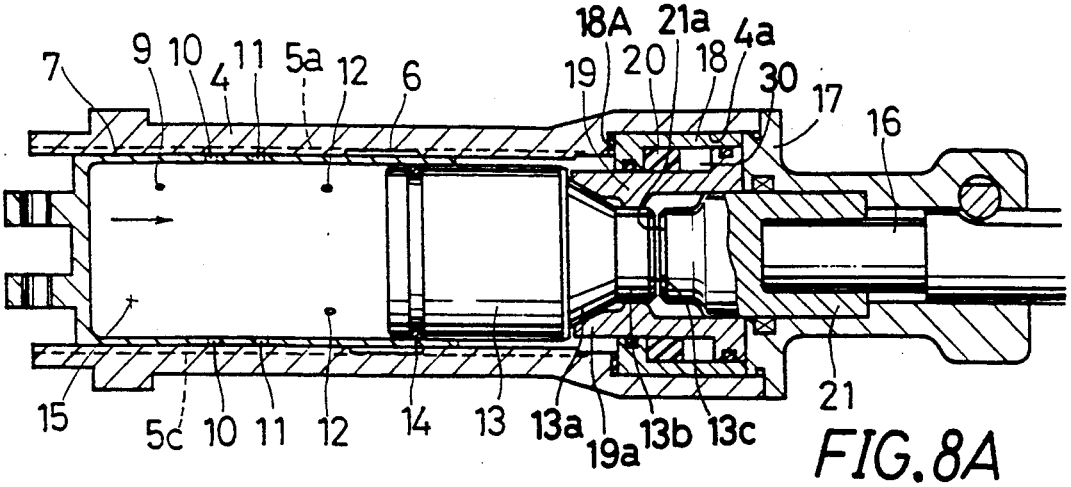
FIGS. 8A to 8D are views similar to FIG. 2 but showing various operational positions for preventing idle percussive action of a striker.

Firstly, the operation for preventing the striker 13 from idling will be explained. In such operation, the tool bit 16 is not mounted on the tool holder 17 or the forward end of the tool bit 16 mounted on the tool holder 17 is not pressed on a work, and the operation will be explained in connection with the latter case. When the forward end of the tool bit 16 is not pressed on the work, the tapered shaft portion 13*a* of the striker 13 is kept in contact with the tapered portion 19*a* of the impact bolt holder 19 and the striker 13 is positioned at its most forward position as shown in FIG. 8A. The impact bolt holder 19 and the impact bolt 21 are also positioned at their most forward positions When the motor is started for driving the cylinder 7 which is positioned at the most rearward position (the upper dead center) through the crank mechanism and the rod 8, the cylinder 7 is moved forwardly within the barrel 4 so as to compress the air within the air chamber 15. In this stage, the air chamber 15 is communicated with the second ventilation holes 12 which communicate with the outside through the ventilation grooves 5*a* to 5*d*. Thus, the air chamber 15 is communicated with the outside, and therefore, the air within the air chamber 15 may not be compressed (see FIG. 5).

Figure 7:
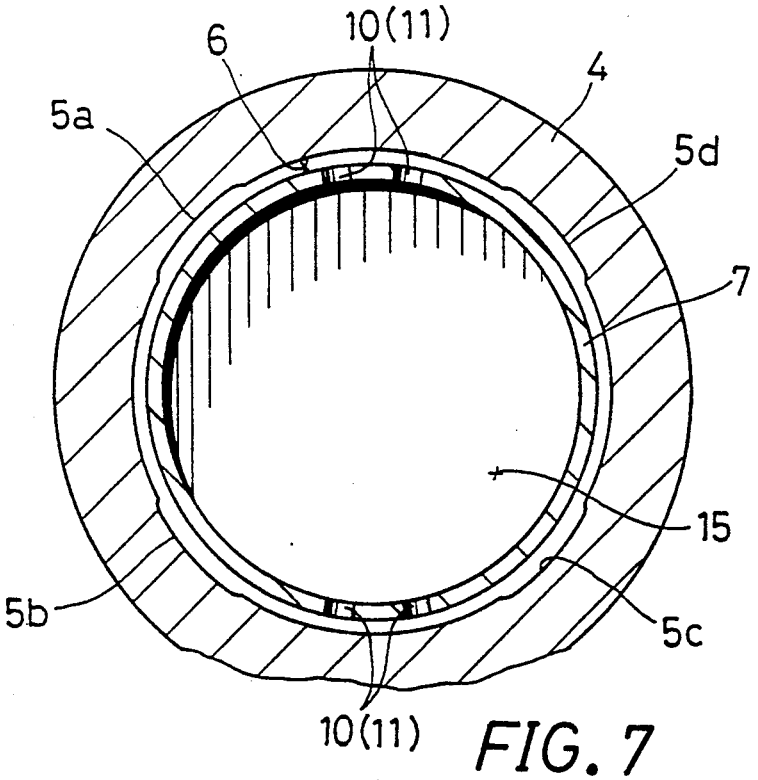
FIG. 7 is an enlarged sectional view taken along the line VII—VII in FIG. 8D.
Figure 8B:
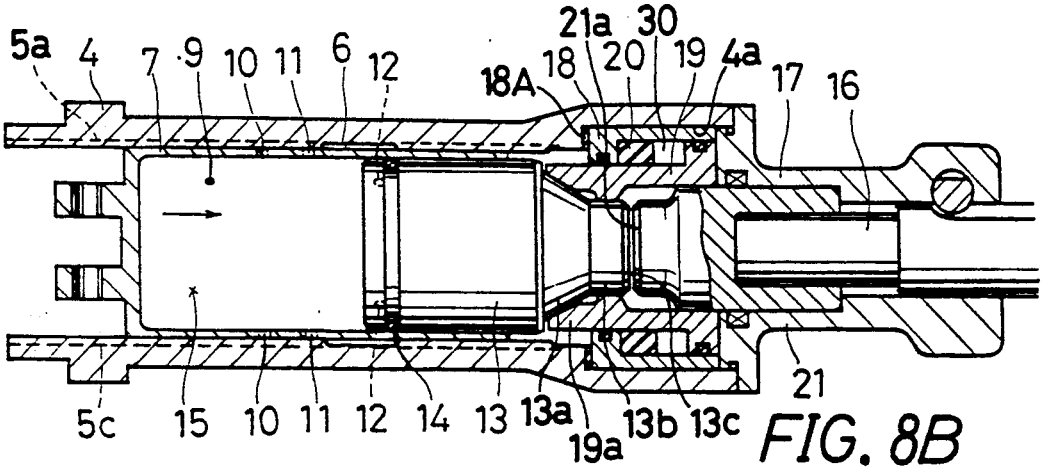
Figure 8C:
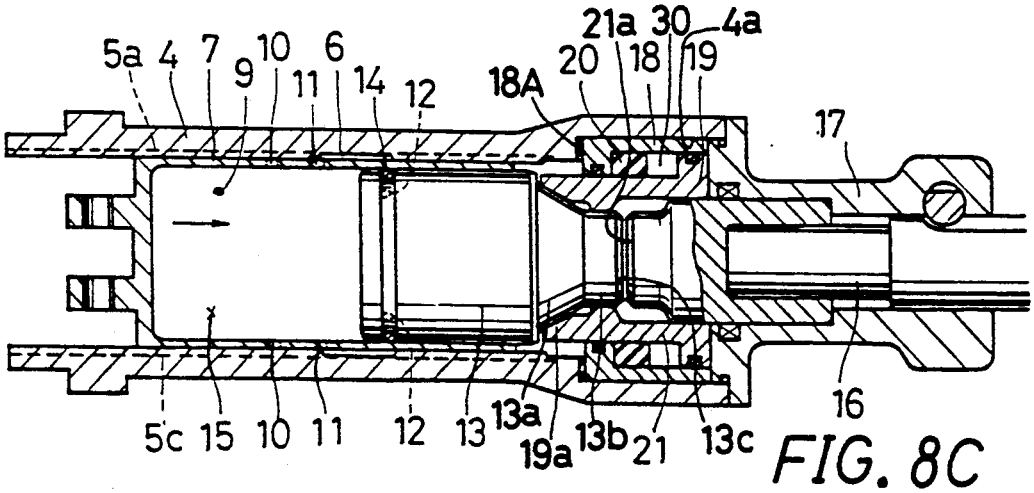

As the cylinder 7 moves forwardly, the second ventilation holes 12 are closed by the striker 13 which is positioned at the most forward position, so that the air chamber 15 is closed as shown in FIG. 8B. However, as shown in FIGS. 7 and 8C, the intermediate ventilation holes 11 subsequently communicate with the annular groove 6 which communicates with the ventilation grooves 5*a* to 5*d*, so that the air chamber 15 communicates with the outside. Therefore, the air within the air chamber 15 is still not compressed.

Figure 8D:
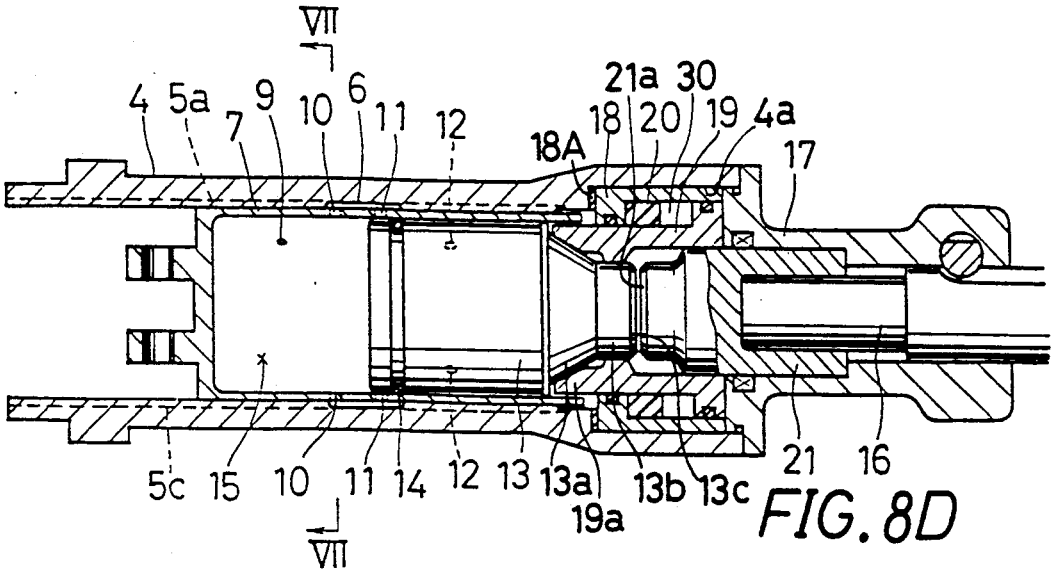

When the cylinder 7 moves further forwardly to reach the most forward position (the lower dead center), the first ventilation holes 10 communicate with the annular groove 6 in addition to the intermediate ventilation holes 11 as shown in FIGS. 7 and 8D, so that the air chamber 15 is kept in communication with the outside and the air within the air chamber 15 may not be compressed.

When the cylinder 7 returns from the most forward position to the most rearward position or from the lower dead center to the upper dead center, the air chamber 15 is kept in communication with the outside in the opposite order as explained above, so that no negative pressure is produced within the air chamber 15 and therefore, the striker 13 does not move rearwardly to follow the cylinder 7.

Thus, the air within the air chamber 15 is not compressed and does not produce negative pressure when the cylinder 7 moves forwardly and rearwardly, respectively, so that the striker 13 is maintained at its most forward position. This may prevent idling of the striker 13 during the movement of the cylinder 7.

The normal impact operation will be hereinafter explained.

In the normal impact operation the forward end of the tool bit 16 mounted on the tool holder 17 is pressed on the work.

In case of that the tool bit 16 is pressed on the work while the cylinder 7 is positioned in the vicinity of the most forward position or lower dead center as shown in FIG. 8D, the impact bolt holder 19 as well as the impact bolt 21 is moved to its most rearward position through the pressing operation of the tool bit 16, and the striker 13 is subsequently moved rearwardly by the impact bolt 21. During such rearward movement of the striker 13, the air within the air chamber 15 may not be compressed since the first ventilation holes 10 as well as the second ventilation holes 11 communicate with the annular groove 6 and the air within the air chamber 15 is positively exhausted to the outside through any one of the first and second ventilation holes 10 and 11. Therefore, the operation for pressing the tool bit 16 on the work can be performed smoothly without causing lift of the tool. The striker 13 is subsequently moved to reach a position in which the seal ring 14 is positioned rearwardly of the annular groove 6 of the barrel 4, so that the first and second ventilation holes 10 and 11 may be prevented from communication with the air chamber 15 so as to seal the air chamber 15 from the outside.

In case that the tool bit 16 is pressed on the work while the cylinder 7 is positioned at a middle position between the most forward position and the most rearward position or between the lower dead center and the upper dead center as shown in FIG. 8C, the intermediate ventilation holes 11 are in a position to communicate with the annular groove 6. Therefore, the air within the air chamber 15 is exhausted to the outside through the intermediate ventilation holes 11 when the striker 13 is moved by the pressing operation of the tool bit 16. Therefore, the operation for pressing the tool bit 16 on the work can be also performed smoothly without causing lift of the tool bit 16. When the striker 13 is moved to reach a position in which the seal ring 14 is positioned rearwardly of the annular groove 6 of the barrel 4 as described above, the intermediate ventilation holes 11 may be prevented from communication with the air chamber 15 so as to seal the air chamber 15 from the outside.

Further, in case that the tool bit 16 is pressed on the work while the cylinder 7 is at a position around the most rearward position or the upper dead center as shown in FIG. 8A, the air within the air chamber 15 is positively exhausted to the outside through the ventilation grooves 5*a* to 5*d* since the second ventilation holes 12 are in a position to communicate with the ventilation grooves 5*a* to 5*d* which further communicate with the outside. Therefore, the air within the air chamber 15 may not be compressed as the above case, so that the operation for pressing the tool bit 16 on the work can be also smoothly performed without causing lift of the tool. When the striker 13 is moved to reach a position in which the seal ring 14 is positioned rearwardly of the annular groove 6 of the barrel 4, the intermediate ventilation holes 11 may be prevented from communication with the air chamber 15 so as to seal the air chamber 15 from the outside as the above case.

With the tool bit 16 maintained to be pressed on the work, the motor is started to move the cylinder 7 forwardly relative to the barrel 4 from the most rearward position to the most forward position or the lower dead center so as to compress the air within the air chamber 15. As the cylinder 7 is thus moved, the second ventilation holes 12, the intermediate ventilation holes 11 and the first ventilation holes 10 are successively sealed by the seal ring 14 of the striker 13, so that the air chamber 15 is kept air tight (see FIGS. 9A and 9B).

As the cylinder 7 returns from the most forward position to the most rearward position, the pressure within the air chamber 15 becomes negative since the air chamber 15 is kept air tight as described above. The striker 13 is consequently moved to return to the most rearward position in a manner to be drawn within the air chamber 15 (see FIGS. 9B and 9C).

Figure 9A:
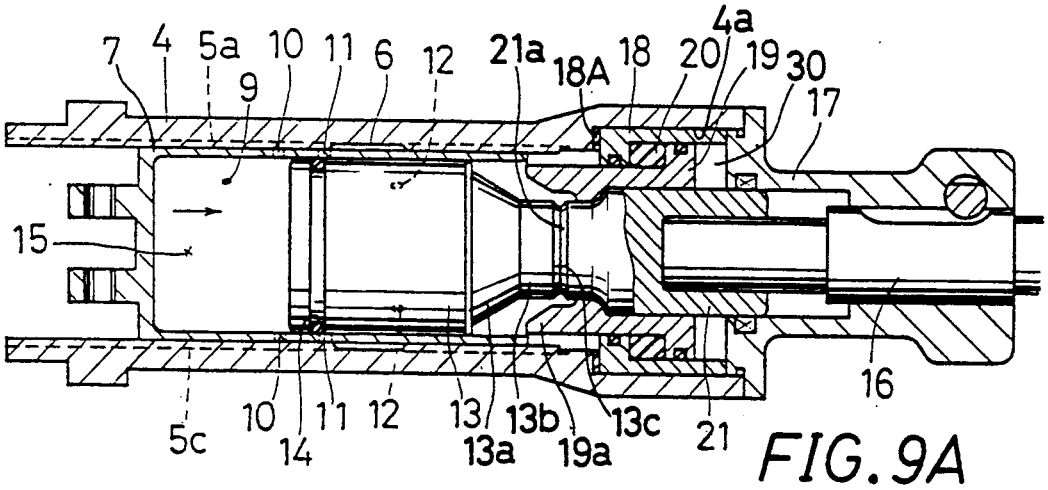
FIGS. 9A to 9G are views similar to FIG. 2 but showing various operational positions for normal impact operation.
Figure 9B:
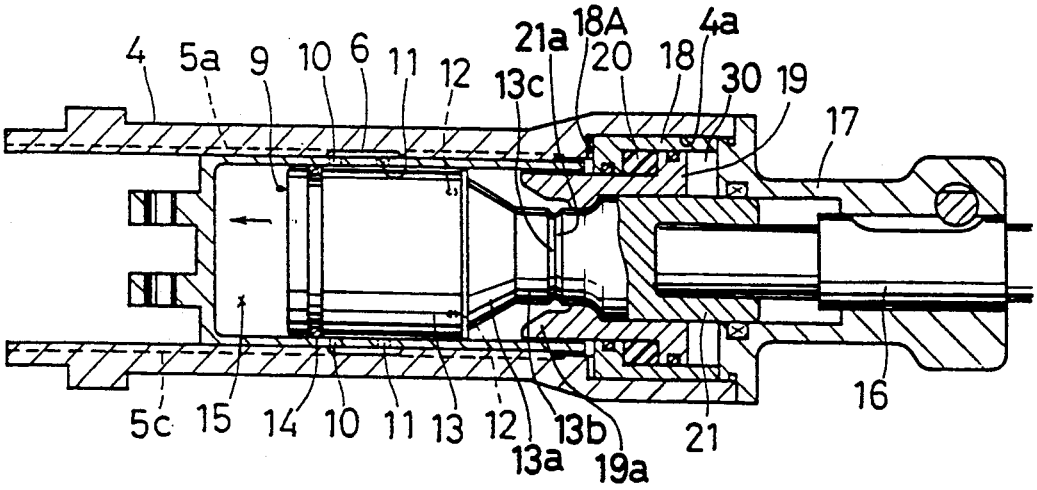
Figure 9C:
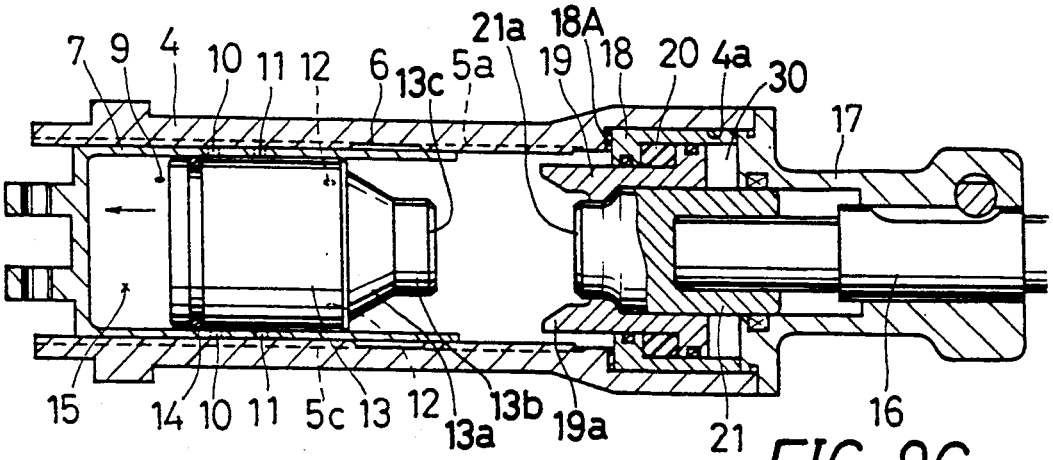
Figure 9D:
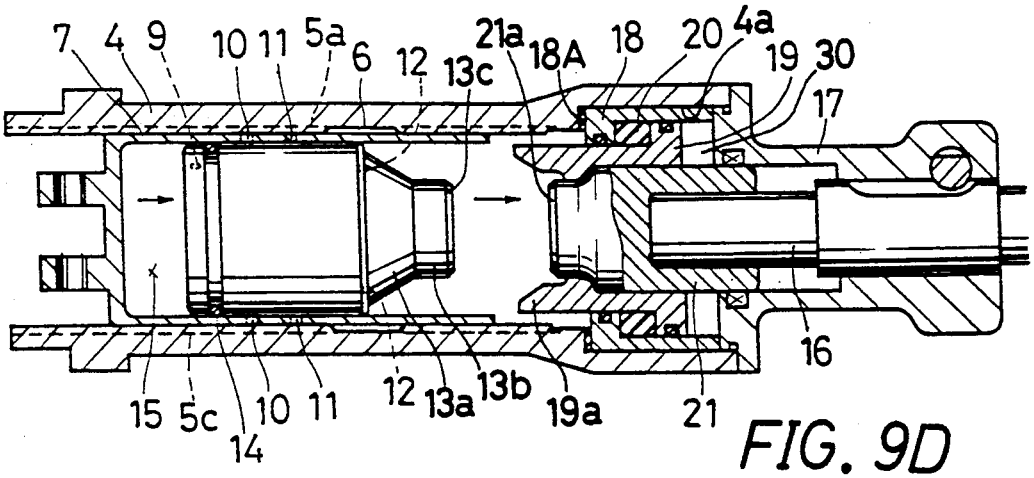
Figure 9E:
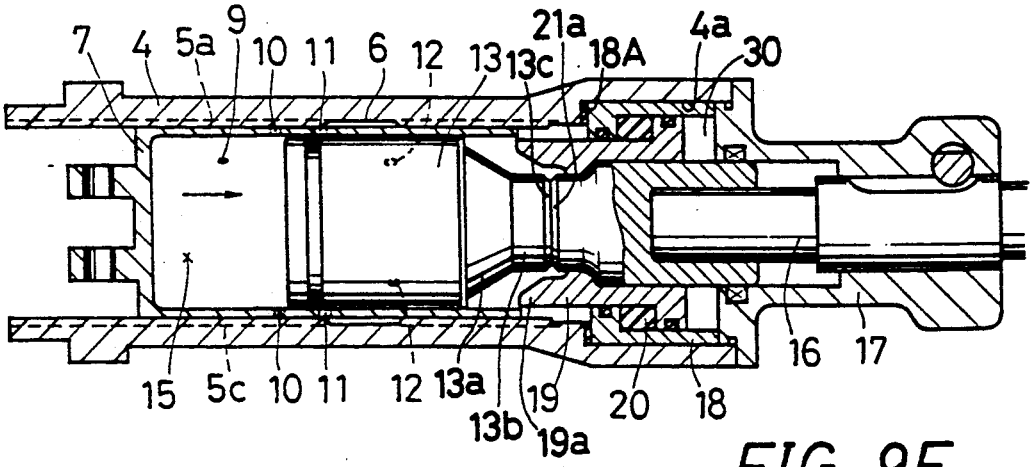
Figure 9F:
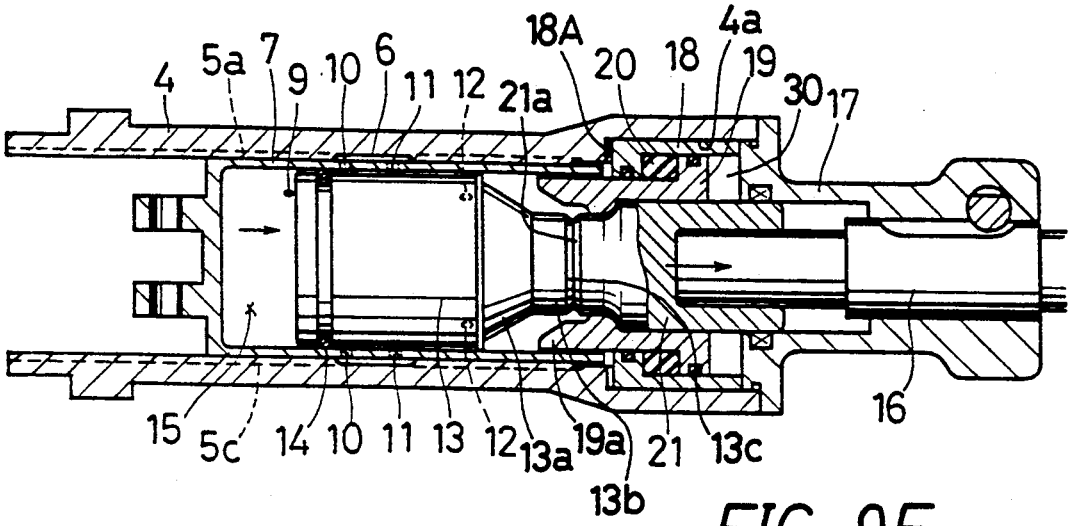
Figure 9G:
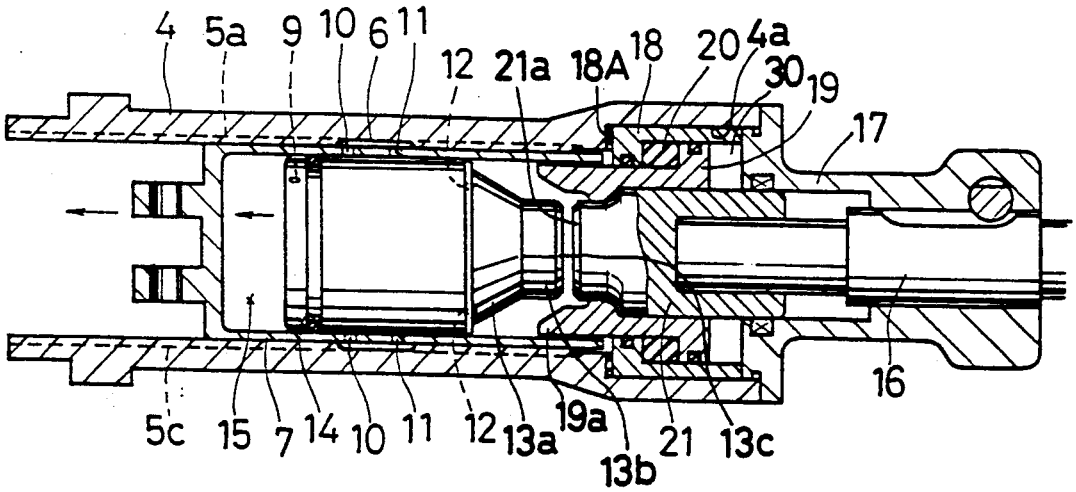
Figure 10:
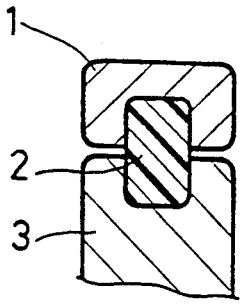
FIG. 10 is an enlarged sectional view taken along the line X—X in FIG. 1.

The cylinder 7 is subsequently moved again forwardly from the rearward position so as to compress the air within the air chamber 15, and the striker 13 is urged to move toward the impact bolt 21 by the pressure of the compressed air (see FIGS. 9E and 9F). As the cylinder 7 is further moved to reach the most forward position, the striker 13 is also moved in the same direction to deliver strong impact to the impact bolt 21 by the impact shaft portion 13*b* (see FIGS. 9E and 9F).

The impact bolt 21 is thus urged forwardly together with the tool bit 16, so that the tool bit 16 may impart impact to the work.

The striker 13 rebounds by a small distance as a result of reaction of the impact to the impact bolt 21.

As described above, the striker 13 reciprocally moves following the movement of the cylinder 7 from the most forward position to the most rearward position and the subsequent returning movement from the most rearward position to the most forward position.

While the invention has been described with reference to a preferred embodiment thereof, it is to be understood that modifications or variations mey be easily made without departing from the scope of the present invention which is defined by the appended claims.

What is claimed is:

1. An impact tool comprising:

a body;

a barrel mounted on said body;

a mounting portion of a tool bit disposed at a forward end of said barrel;

a cylinder disposed within said barrel and having a closed rear end and an open forward end, said cylinder forming between the inner wall of said barrel a communication groove which communicates with the outside, and having a plurality of communication holes formed in a radial direction and spaced from each other at a predetermined distance in a longitudinal direction of said cylinder;

a drive mechanism mounted on said body and connected with said cylinder so as to reciprocally move said cylinder within said barrel; and a striker reciprocally movable within said cylinder so as to form an air chamber between the inner wall of said cylinder, said striker being positioned at a first position when said tool bit mounted on said mounting portion is not pressed on a work, and being movable to a second position rearward of said first position through the pressing operation of said tool bit on the work;

wherein said striker at said first position permits communication between said air chamber and said communication groove through any one of said communication holes during the reciprocal movement of said cylinder within said barrel, so that said striker may be prevented from idle impact, and wherein said striker at a position rearwardly of said second position prevent communication between said air chamber and said communication groove, so that said striker may be reciprocally moved as the movement of said cylinder so as to permit normal impact operation by said tool bit.

2. The impact tool as defined in claim 1 wherein said communication holes include at least one first communication hole and at least one second communication hole.

3. The impact tool as defined in claim 2 wherein said communication holes further include at least one intermediate communication hole disposed between said first communication hole and said second communication hole.

4. The impact tool as defined in claim 2 wherein said first communication hole communicates with said communication groove when said cylinder reaches a position in the vicinity of its forward stroke end and wherein said second communication hole communicates with said communication groove throughout the movement of said cylinder and is closed by said striker when said striker is positioned at said second position or rearwardly of said second position.

5. The impact tool as defined in claim 4 wherein said first communication hole and said second communication hole are displaced from each other in a circumferential direction of said cylinder, and wherein said communication groove includes a first groove and at least one second groove formed on the inner wall of said barrel, said first groove being positioned to circumferentially coincide with said first communication hole and has a predetermined width in a longitudinal direction of said barrel, while said second groove being positioned to circumferentially coincide with said second communication hole and extending in the longitudinal direction of said barrel.

6. The impact tool as defined in claim 5 wherein a plurality of said first communication holes and a plurality of said second communication holes are disposed at a predetermined distance in a circumferential direction to each other, respectively, and wherein said first groove has annular profile and a plurality of second grooves are provided in correspondence to said second communication holes.

7. The impact tool as defined in claim 6 wherein said first groove and said second grooves communicate with each each other, and wherein said first groove communicate with the outside through said second grooves.

8. An impact tool comprising:

a body;

a barrel mounte don said body;

a mounting portion of a tool bit disposed at a forward end of said barrel;

a cylinder disposed within said barrel and having a closed rear end and an open forward end, said cylinder forming between the inner wall of said barrel a communication groove which communicates with the outside, and having at least two communication holes formed in a radial direction and spaced from each other at a predetermined distance in a longitudinal direction of said cylinder;

a drive mechanism mounted on said body and connected with said cylinder so as to reciprocally move said cylinder within said barrel; and a striker reciprocally movable within said cylinder so as to form an air chamber between the inner wall of said cylinder, said striker being positioned at a first position when said tool bit mounted on said mounting portion is not pressed on a work, and being movable to a second position rearward of said first position through the pressing operation of said tool bit on the work;

said communication holes including:

a first communication hole which permits communication between said air chamber and said communication groove when said striker is positioned at said first position and when said cylinder is positioned at its rearward stroke end, the communication between said air chamber and said communication groove through said first communication hole being prevented when said cylinder is positioned at its forward stroke end; and a second communication hole which permits communication between said air chamber and said communication groove when said stroker is positioned at said first position and when said cylinder is positioned at said forward stroke end, the communication between said air chamber and said communication groove through said second communication hole being prevented when said cylinder is positioned at said rearward stroke end;

any of said communication holes including said first and second communication holes permitting communication between said air chamber and said communication groove throughout the movement of said striker between said forward stroke end and said rearward stroke end when said striker is positioned at said first position, so that said striker can be prevented from performing idle impact;

wherein the communication between said air chamber and said communication hole through said communication holes is prevented when said striker is at a position rearwardly of said second position, so that the percussive operation through said tool bit can be made.

* * * * *